US009572413B2

(12) United States Patent
Zhang

(10) Patent No.: US 9,572,413 B2
(45) Date of Patent: Feb. 21, 2017

(54) MOVABLE BELT MASCARA APPLICATOR

(71) Applicant: Derik Zhang, Liaobu Town Dongguan (CN)

(72) Inventor: Derik Zhang, Liaobu Town Dongguan (CN)

( * ) Notice: Subject to any disclaimer, the term of this patent is extended or adjusted under 35 U.S.C. 154(b) by 883 days.

(21) Appl. No.: 13/987,166

(22) Filed: Jul. 8, 2013

(65) Prior Publication Data

US 2015/0007843 A1 Jan. 8, 2015

(51) Int. Cl.
*A45D 40/26* (2006.01)

(52) U.S. Cl.
CPC ..... *A45D 40/262* (2013.01); *A45D 40/264* (2013.01)

(58) Field of Classification Search
CPC .... A45D 40/26; A45D 40/262; A45D 40/264; A45D 40/265; A45D 40/267; A45D 24/02; A45D 2200/10
USPC ..... 401/175, 208, 219
See application file for complete search history.

(56) References Cited

U.S. PATENT DOCUMENTS 2,057,085 A * 10/1936 Danco ..... A45D 40/261 206/385
4,627,758 A * 12/1986 Winthrop ..... A45D 29/007 132/74.5
6,220,254 B1 * 4/2001 Gueret ..... A45D 40/267 132/218
2011/0262208 A1 * 10/2011 Edmondson ..... A45D 34/04 401/146

* cited by examiner

*Primary Examiner* — Todd E Manahan
*Assistant Examiner* — Brianne Kalach
(74) *Attorney, Agent, or Firm* — William W. Haefliger

(57) ABSTRACT

A mascara application device, comprising a container for mascara a manually operable actuator, feed mechanism carried by the container to feed mascara to a loading station, in response to operation of the actuator, a belt having applicator brushes to receive mascara at the loading station as the actuator is operated, guide means to guide actuator induced belt displacement relative to the container to position the brushes for mascara application to eye lashes.

18 Claims, 7 Drawing Sheets

FIG. 17
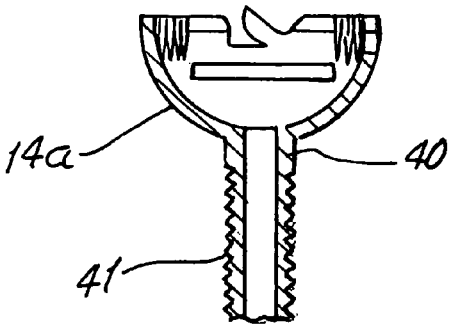
FIG. 18
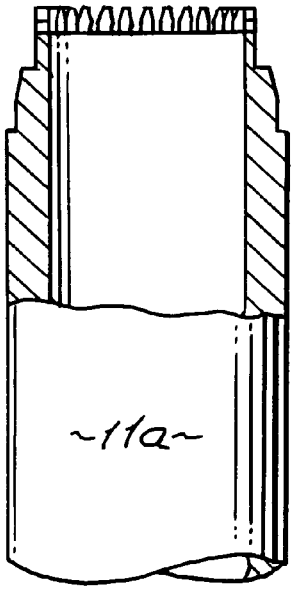
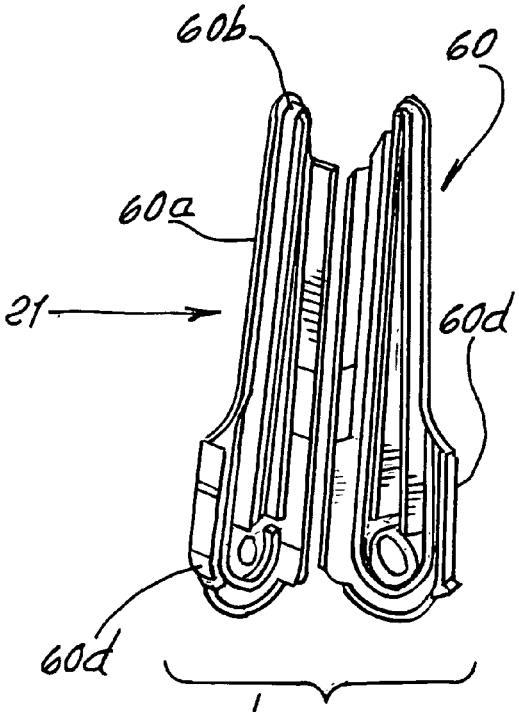
FIG. 19

MOVABLE BELT MASCARA APPLICATOR

BACKGROUND OF THE INVENTION

This invention relates generally to controlled feeding application of cosmetic liquid, such as mascara, to eye lashes or to other facial zones; and more particularly relates to an improved device to feed mascara from a container onto brushes on a belt, at controlled rate, as for example as related to desired delivery of mascara to eye lashes.

There is need for simple, compact, easily manually controlled and operated devices that accurately delivers mascara to eye zones, at controlled rates. Prior devise lacked the related integrated improvements, in a highly compact assembly characterized by the present invention.

SUMMARY OF THE INVENTION

It is a major object of the invention to provide an improved, compact, mascara application device that basically comprises:

a) a container for mascara b) a manually operable actuator, c) feed mechanism carried by the container to feed mascara to a loading station, in response to operation of the actuator, d) a belt having applicator brushes to receive mascara at the loading station as the actuator is operated, e) guide means to guide actuator induced belt displacement relative to the container to position the brushes for mascara application to eye lashes.

As will be seen, the belt is typically a compact, endless belt; the mechanism includes an actuator that is manually controllably rotatable; and the actuator is operatively coupled to both the feed mechanism and to the belt whereby the user may simultaneously control both displacement of mascara fluid onto the belt, and belt brush displacement relative to the user's eye lashes for accurate control of mascara application.

Another object is to provide a spindle, and first gearing associated with the spindle to rotate the spindle about a transverse axis as the actuator is manually rotated about a longitudinal axis, and second gearing associated with the spindle and belt to drive the belt endwise in response to said spindle rotation. Such first gearing may advantageously include interengaged teeth on an actuator part and extending about the longitudinal axis, and teeth on the spindle extending about the transverse axis. Also, the second gearing typically includes gear teeth on the belt at its inner side, with belt brushes presented at the belt outer side.

Further, as the actuator is rotated, it displaces a pusher in the container to in turn displace or feed mascara to the loading zone.

These and other objects and advantages of the invention, as well as the details of an illustrative embodiment, will be more fully understood from the following specification and drawings, in which:

DRAWING DESCRIPTION

Figure 15:
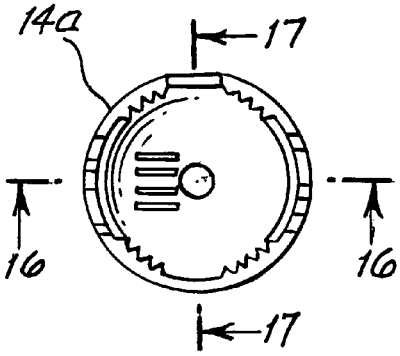
FIG. 15 is an end view of actuator part that is rotatable to displace the fluid pusher.
Figure 14:
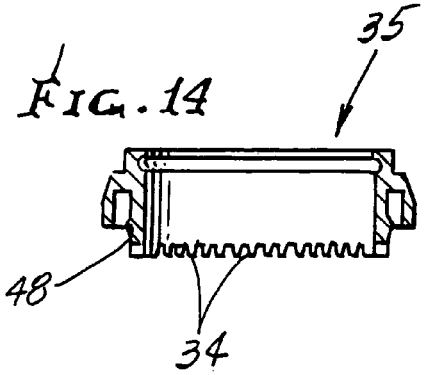
FIG. 14 is a section taken on lines 14-14 of FIG. 13.
Figure 16:
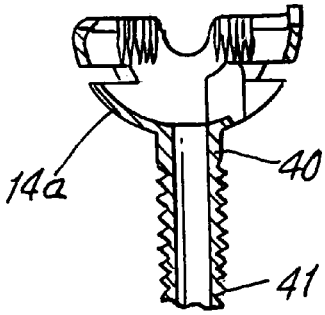

FIG. 16 section taken on lines 15-15 of FIG. 15*p*

FIG. 17 is a section taken on lines 17-17 of FIG. 15;

FIG. 18 is a fragmentary elevation showing support body structure; and

FIG. 19 is a perspective view showing construction of driver structure that supports and positions the belt that carries applicator brushes.

DETAILED DESCRIPTION

Figure 1:
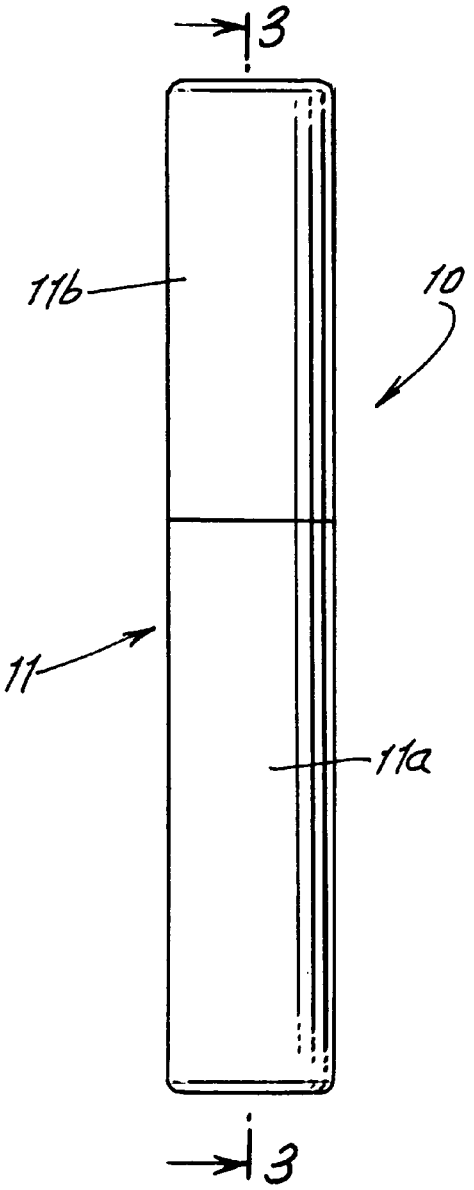
FIG. 1 is a side elevation view of apparatus embodying the invention.
Figure 2:
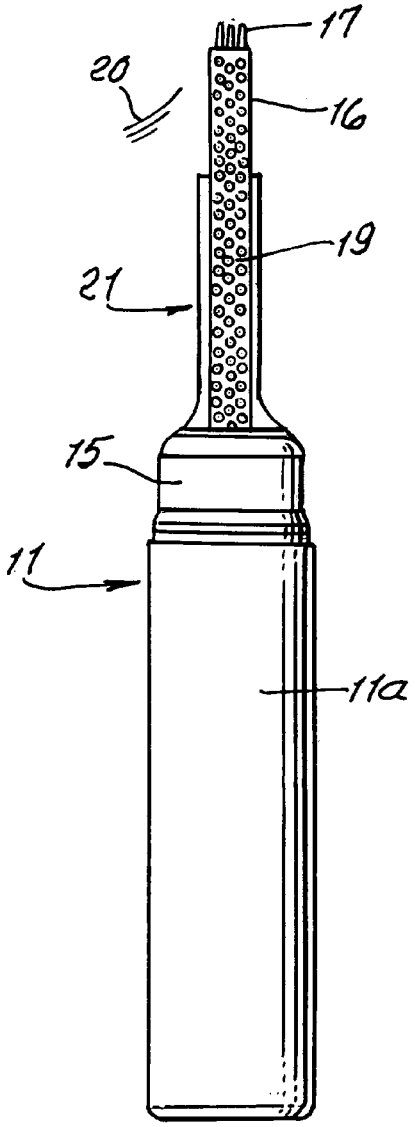
FIG. 2 is a view like FIG. 1, with a cap removed and showing brushes ready for use.
Figure 3:
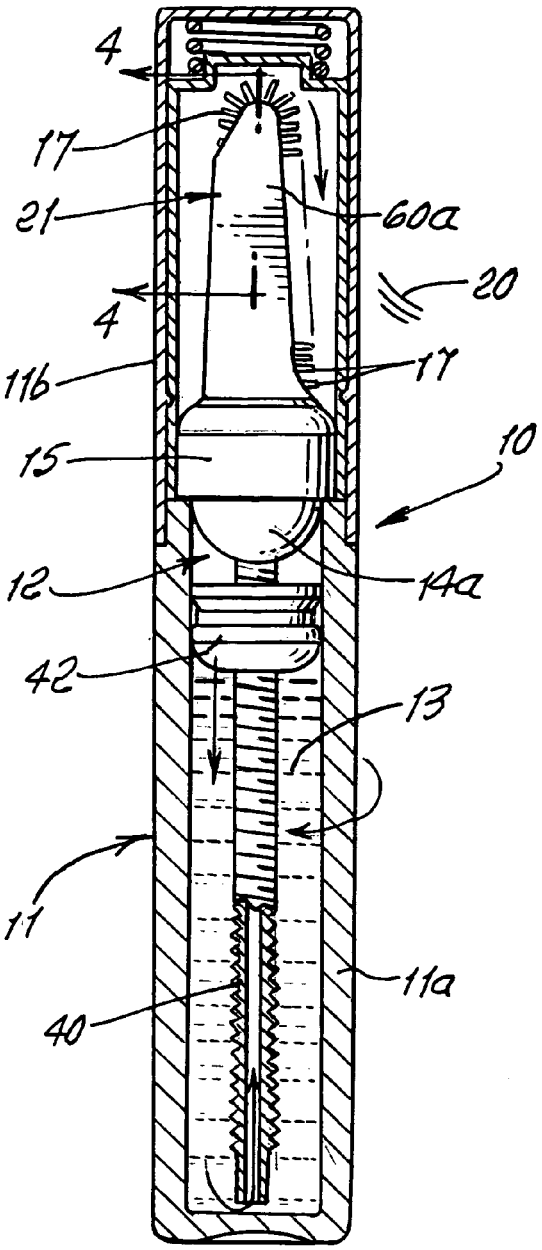
FIG. 3 is a vertical section taken on lines 3-3 of FIG. 1.
Figure 4:
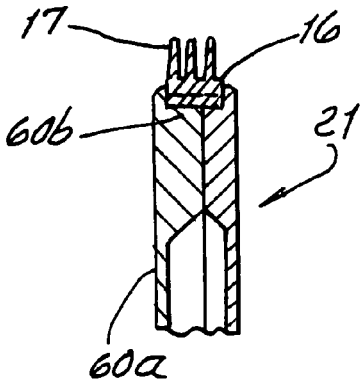
FIG. 4 is a fragmentary vertical section taken on lines 4-4 of FIG. 3.
Figure 5:
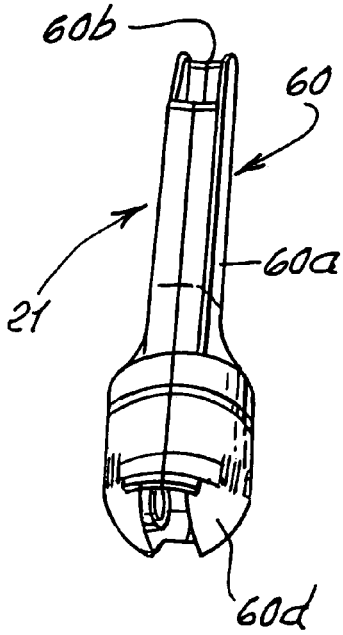
FIG. 5 is a perspective view showing a brush belt driver.
Figure 6:
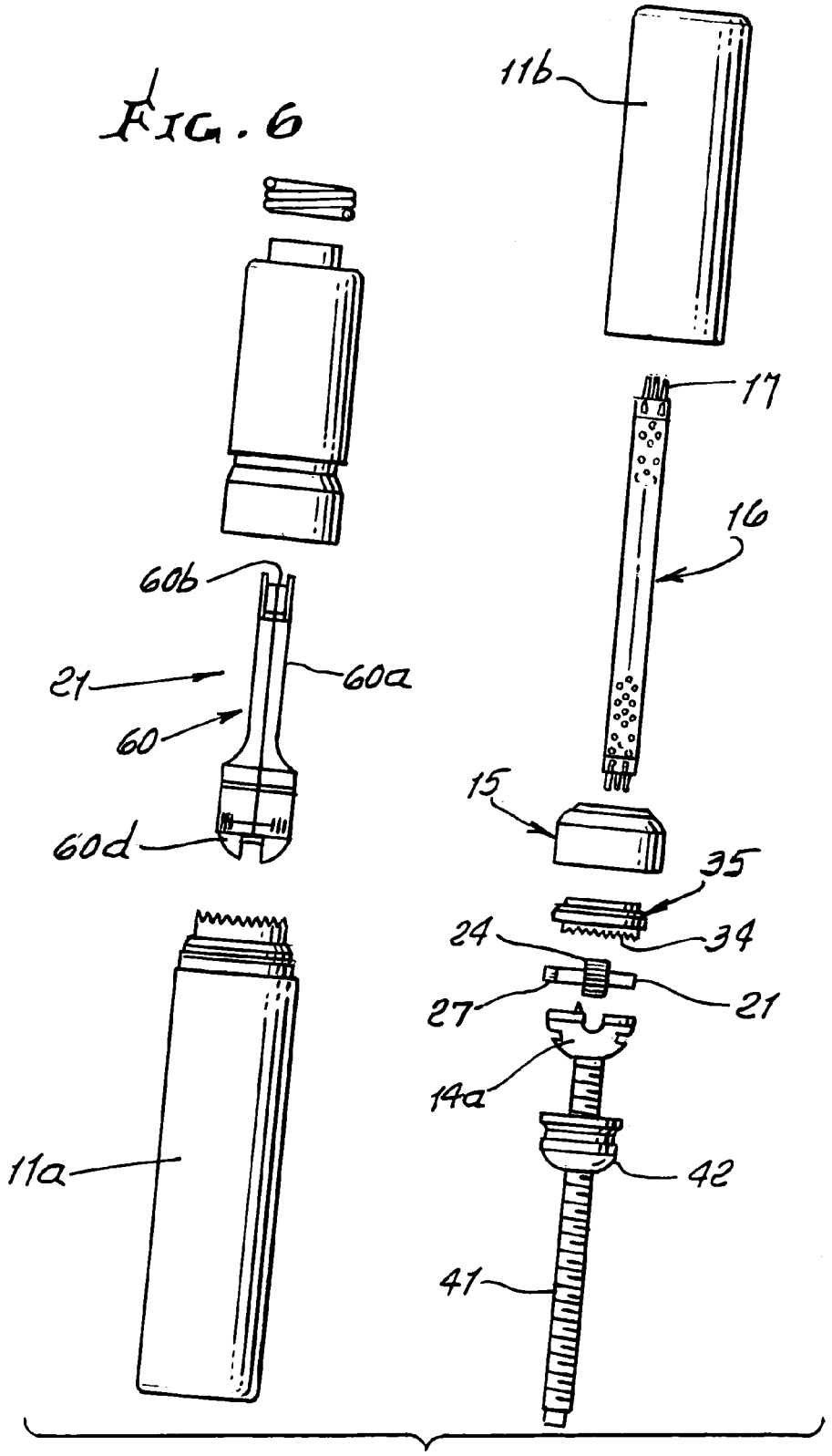
FIG. 6 is an exploded elevation showing positioning of the driver between the cap and body of the apparatus.

Referring first to FIGS. 1-3, they show a representative mascara application device 10 that includes, generally, a container 11 for liquid mascara having a main body 11*a* and a cap 11*b* fitting endwise toward body 11*a*, and being endwise removable. Feed mechanism shown generally at 12 is carried by the container to feed mascara 13 in body 11*a* to a loading station or zone indicated at 14 in FIG. 8 in response to operation, such as rotation of a manually rotatable actuator 15, after removal of cap 11*b*.

Figure 8:
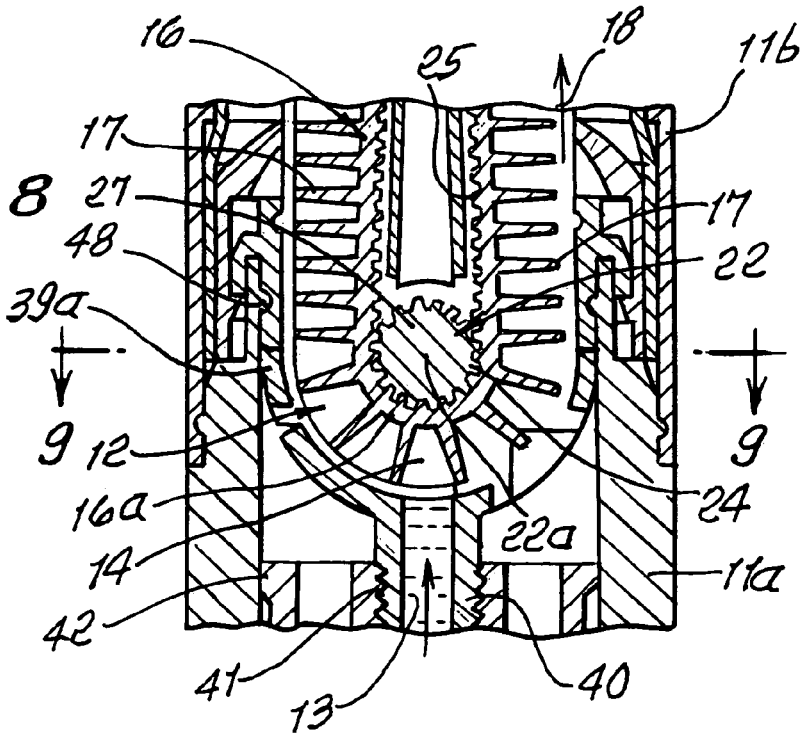
FIG. 8 is a vertical section taken on lines 8-8 of FIG. 7.
Figure 9:
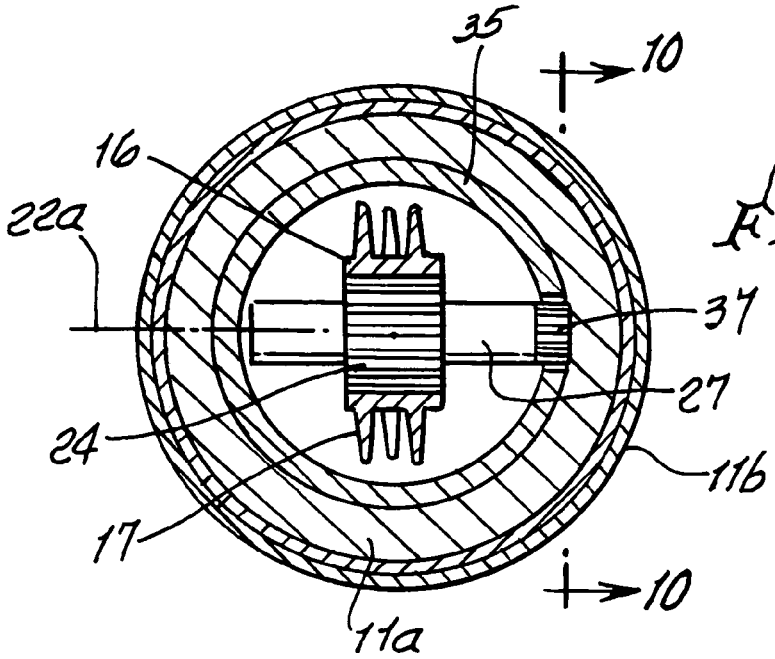
FIG. 9 is a horizontal section taken on lines 9-9 of FIG. 8.

An endless belt 16 has or carries applicator brushes 17 which, at the loading zone 14, receive or pick up mascara fluid as the actuator is operated, for travel indicated by arrow 18 away from body 11*a* and toward zone 19 exposed to the exterior, for application to the user's eye lashes 20, as the user manually manipulates the hand held container body 11*a*. Belt travel or endwise displacement is guided by elongated guide means or structures indicated generally at 21 FIG. 8 shows belt drive gear 22 rotatable about transverse axis 22*a*, in response to rotation of the actuator 15, about longitudinal axis 22*b*. Gear teeth 24 engage internal gear teeth 25 integral with the belt, to drive the belt. Gear teeth 34 on the actuator sleeve 35 engage gear teeth 36 on the spindle 27. Spindle 27 is rotatable about axis 22*a*.

Accordingly, second gearing is provided to rotate a spindle about a transverse axis 22*a* in response to actuator rotation about a longitudinal axis; and first gearing is provided to advance the belt longitudinally in response to said spindle rotation. More specifically, first gearing is associated with the spindle to rotate the spindle about a transverse axis 22*a* as the actuator is manually rotated about a longitudinal axis 22*b*, and second gearing is associated with the spindle and belt to drive the belt endwise in response to such spindle rotation. Also, the second gearing includes gear teeth 25 on the belt inner side, belt brushes 17 being presented at the belt outer side. Also, the first gearing includes interengageable teeth on an actuator part and extending about said longitudinal axis and the teeth on the spindle.

Figure 7:
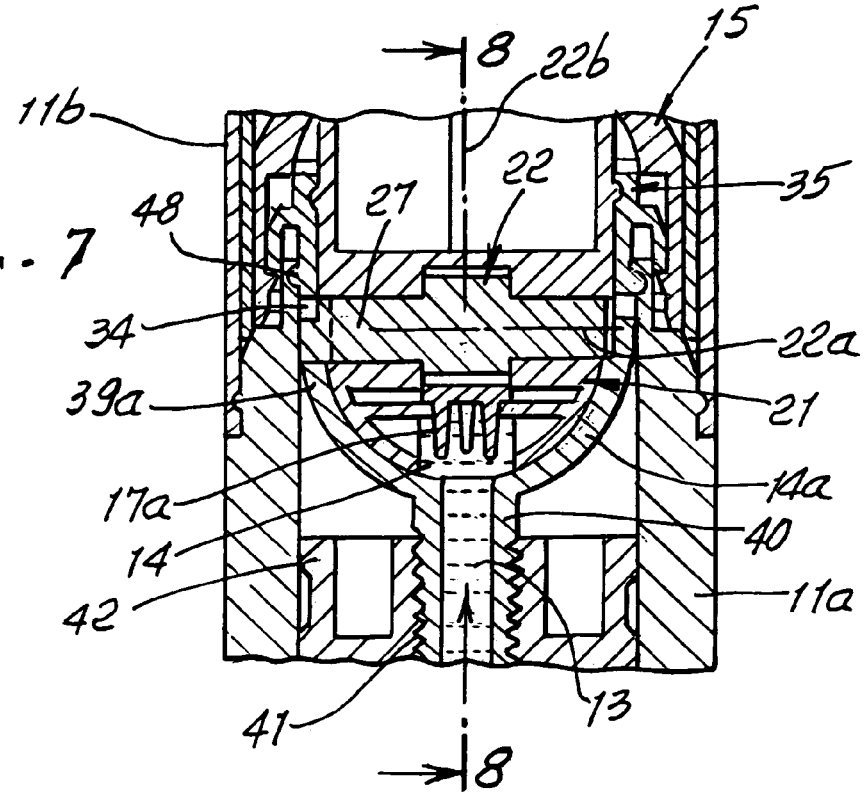
FIG. 7 is an enlarged fragmentary vertical section taken through elements of the belt driver which also drives a fluid pusher to supply fluid to the belt.

FIG. 8 shows cup shaped loading zone 14 formed by the actuator, into which the lowermost end portion 16*a* of the belt 16 dips, to enable bristles or brushes 17 to scoop up liquid mascara to be transported to the eyelash application zone 19, as the belt is advanced endwise and turns 180° in cup 14*a*. Liquid mascara is proportionally delivered toward the zone 19 as the actuator is rotated, the cup zone 14 forming a 180° turn brush guide. Such actuator rotation also rotates a mascara delivery tube 40, having threaded engagement at 41 with a pusher piston 42 in the container body. As the tube 40 rotates, the piston 42 is driven downwardly in the container body interior, to push mascara into and upwardly in the tube 40, for upwardly supply to the loading zone 14, in a delivery amount proportioned to mascara pick-up by the belt bristles projecting at 17*a* into the loading zone. FIGS. 7 and 8 also show the actuator rotatable wall 35 having connection at 48 both to wall 39*a* of cup 14*a*, and to the threaded tube 40.

Figure 10:
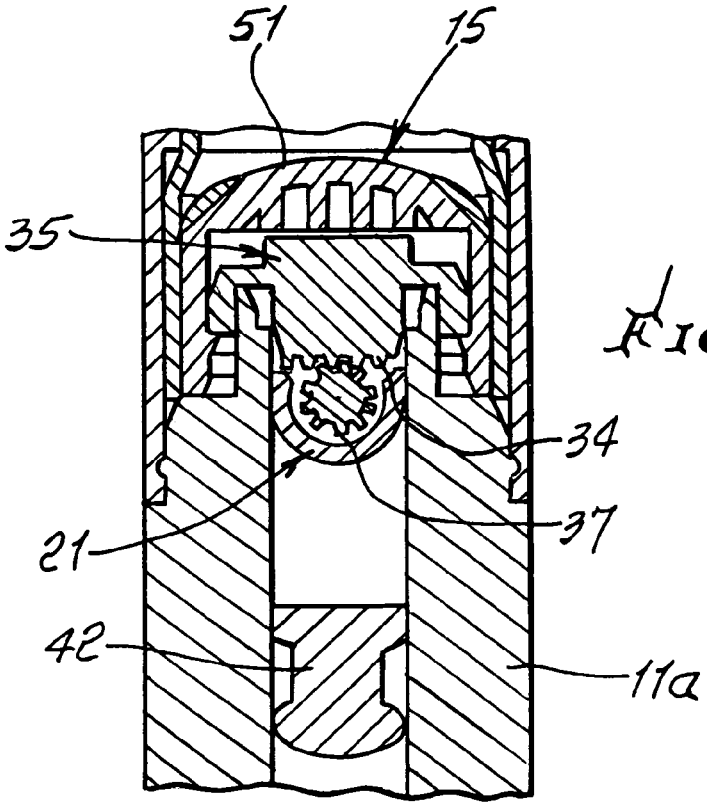
FIG. 10 is a vertical section taken on lines 10-10 of FIG. 9.
Figure 11:
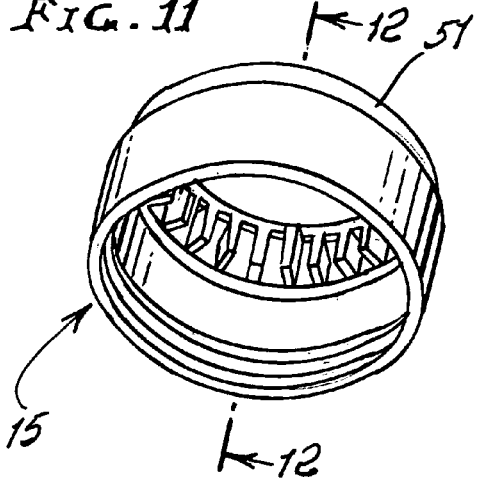
FIG. 11 is a perspective view showing a driver actuator.
Figure 13:
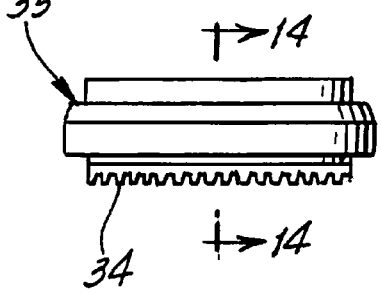
FIG. 13 is an elevation view showing a rotary actuator element that rotates the spur gear shown in FIGS. 9 and 10.
Figure 12:
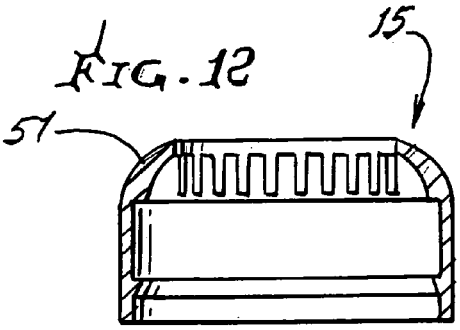
FIG. 12 is a section taken on lines 12-12 of FIG. 11.

FIG. 10 shows a top end wall 51 of the tubular actuator.

FIG. 19 shows the housing 60 acting as guide means for the driving and driven elements. Elongated portion 60*a* of the housing extends protecting at one side of the belt, and terminates at 60*b* to guide the belt extent 16*a* in an exposed reversing travel path at the end of the belt housing. Lowermost extent 60*d* of the housing fits adjacently to the upper extent of the actuator.

I claim:

1. A mascara application device, comprising a) a container for mascara, b) a manually operable actuator, c) feed mechanism carried by the container to feed mascara to a loading station, in response to operation of the actuator, d) an endless elongated belt having applicator brushes to receive mascara at the loading station as the actuator is operated, e) guide means to guide actuator induced belt displacement relative to the container to position the brushes for mascara application to eye lashes, f) said actuator being rotatable about an axis which extends in the direction of belt elongation.

2. The device of claim 1 wherein said belt is an endless elongated belt.

3. The device of claim 1 wherein said actuator is operatively coupled to both said feed mechanism and to the belt.

4. The device of claim 1 wherein said belt is a plastic belt with plastic bristles, the belt extending generally lengthwise at one end of the container, which is elongated to be hand held, whereby said bristles face sidewardly relative to the container.

5. The device of claim 1 wherein said loading station is configured to receive liquid displaced by a pusher in the container, in response to actuator rotation.

6. The device of claim 5 including a liquid mascara pusher in said container, and a driver operatively coupled between said actuator and said pusher.

7. The device of claim 1 including first gearing operatively coupled between said actuator and said belt.

8. The device of claim 1, wherein said loading station is configured to receive liquid displaced by a pusher in the container, in response to actuator rotation and wherein said driver includes rotary gearing.

9. The device of claim 8 including other gearing operatively coupled between said actuator and said belt.

10. The device of claim 9 wherein said actuator is rotatable about an axis which extends in the direction of belt elongation.

11. The method of supplying mascara fluid to an applicator zone, that includes providing the device of claim 1, and a) pressurizing mascara in a supply zone to displace mascara to said loading station, and b) simultaneously employing bristles provided on said belt to scoop mascara from the loading station for belt delivery to said mascara applicator zone for application to eyelashes.

12. The method of claim 11 wherein the rate of mascara delivery to said applicator zone is proportionally related to the rate of mascara delivering to said loading zone.

13. The device which includes;

a) a container for mascara, b) a manually operable actuator, c) feed mechanism carried by the container to feed mascara to a loading station, in response to operation of the actuator, d) a belt having applicator brushes to receive mascara at the loading station as the actuator is operated, e) guide means to guide actuator induced belt displacement relative to the container to position the brushes for mascara application to eye lashes, f) a spindle, and g) first gearing associated with the spindle to rotate the spindle about a transverse axis as the actuator is manually rotated about a longitudinal axis, h) second gearing associated with the spindle and belt to drive the belt endwise in response to said spindle rotation.

14. The device of claim 13 wherein said second gearing includes gear teeth on the belt at its inner side, said belt brushes presented at the belt outer side.

15. The device of claim 14 wherein said first gearing includes interengageable teeth on an actuator part and extending about said longitudinal axis, and teeth on the spindle extending about said transverse axis.

16. A mascara application device, comprising a) a container for mascara b) a manually operable actuator, c) feed mechanism carried by the container to feed mascara to a loading station, in response to operation of the actuator, d) an endless elongated belt having applicator brushes to receive mascara at the loading station as the actuator is operated, e) guide means to guide actuator induced belt displacement relative to the container to position the brushes for mascara application to eye lashes, f) a spindle, and g) first gearing associated with the spindle to rotate the spindle about a transverse axis as the actuator is manually rotated about a longitudinal axis, h) second gearing associated with the spindle and belt to drive the belt endwise in response to said spindle rotation, i) there being a guide sleeve extending about said first gearing to center its rotation, the sleeve also extending into centering relation into said container.

17. The device of claim 16 wherein said guide sleeve extends about said spindle.

18. The device of claim 16 including an annular seal sealing off between said sleeve and said container for mascara.

* * * * *